United States Patent [19]

Farah

[11] Patent Number: 4,877,207

[45] Date of Patent: Oct. 31, 1989

[54] DEVICE FOR CARRYING BAGS, PARTICULARLY REFUSE BAGS

[76] Inventor: Victor Farah, 64-70 av. André Morizet, F-92100 Boulogne, France

[21] Appl. No.: 128,011

[22] PCT Filed: Mar. 11, 1987

[86] PCT No.: PCT/FR87/00067

§ 371 Date: Jan. 6, 1988

§ 102(e) Date: Jan. 6, 1988

[87] PCT Pub. No.: WO87/05579

PCT Pub. Date: Sep. 24, 1987

[30] Foreign Application Priority Data

Mar. 12, 1986 [FR] France ..... 86 03478
Mar. 2, 1987 [FR] France ..... 87 02786

[51] Int. Cl.[4] ..... A63B 55/04
[52] U.S. Cl. ..... 248/97; 248/100
[58] Field of Search ..... 248/97, 99, 95, 100, 248/101; 220/404; 141/314, 391

[56] References Cited

U.S. PATENT DOCUMENTS

| | | | |
|---|---|---|---|
| 655,236 | 8/1900 | Hurd | 248/100 |
| 2,117,689 | 5/1938 | Tatsch | 248/101 |
| 3,847,332 | 11/1974 | Murai | 248/99 |
| 4,267,996 | 5/1981 | Turcott | 248/97 |
| 4,537,377 | 8/1985 | Shewchuk | 248/95 |
| 4,749,011 | 6/1988 | Rylander | 248/99 X |

FOREIGN PATENT DOCUMENTS

| | | | |
|---|---|---|---|
| 0060986 | 9/1913 | Austria | 248/99 |
| 2024421 | 11/1970 | Fed. Rep. of Germany . | |
| 1488392 | 6/1967 | France . | |
| 2304527 | 10/1976 | France . | |

*Primary Examiner*—Ramon O. Ramirez
*Attorney, Agent, or Firm*—William A. Drucker

[57] ABSTRACT

The device converts the bags into baskets, particularly refuse baskets and may support other objects and accessories. The device comprises three supports: a vertical frame, a base and two pivoting rods. The vertical frame and the base are joined by an axis of the two pivoting rods. The vertical frame is locked with the base by means of hooks of the base. The bag is laid having one side supported by the vertical top where the angle thereof passes through the handle of the bag and a portion of the wall covers the rounded sides of the frame. The opposite side of the bag is supported by means at the extremities of the two pivotating rods. The device may be suspended by its angle and the base may be unlocked to let long bags pass through. The vertical frame may have along its two arms a plurality of supporting means to support more twin supporting rods which will carry other bags and/or horizontal supports as that of the base to sustain tissues boxes, etc. and these supports may be mounted on one and/or both sides of the vertical frame which will then have one base on either side.

14 Claims, 5 Drawing Sheets

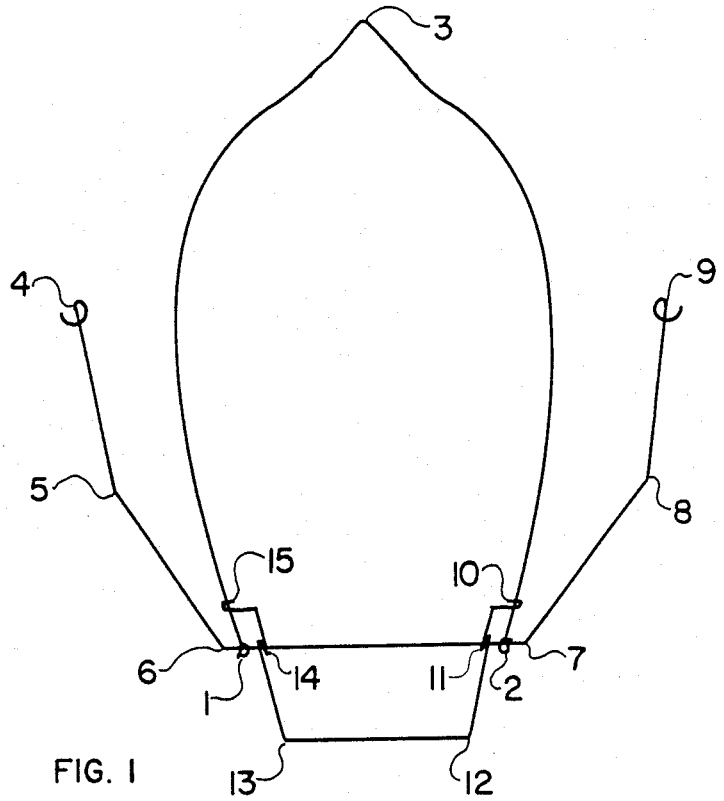
FIG. 1
FIG. 2
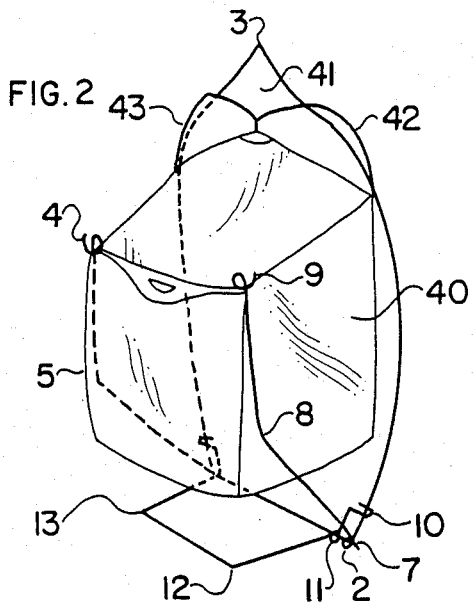
FIG. 3
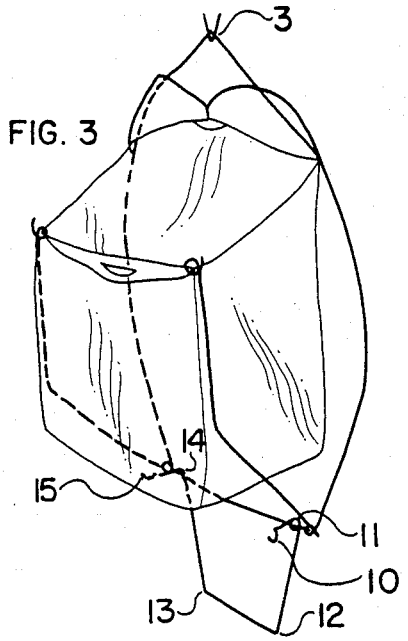

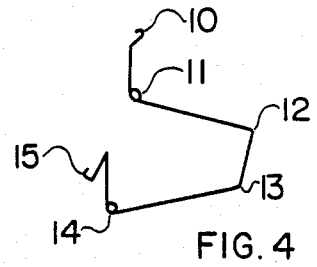
FIG. 4
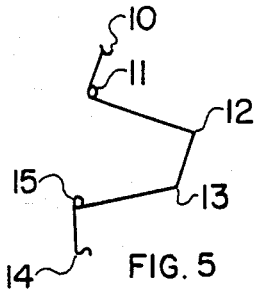
FIG. 5
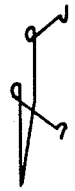
FIG. 6
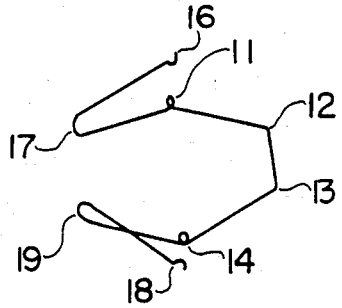
FIG. 7
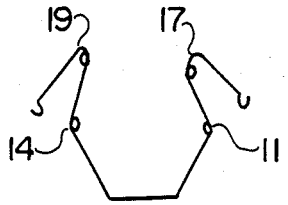
FIG. 8
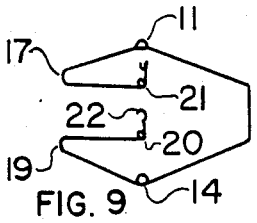
FIG. 9
FIG. 10
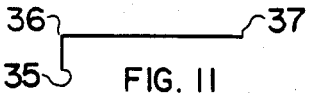
FIG. 11
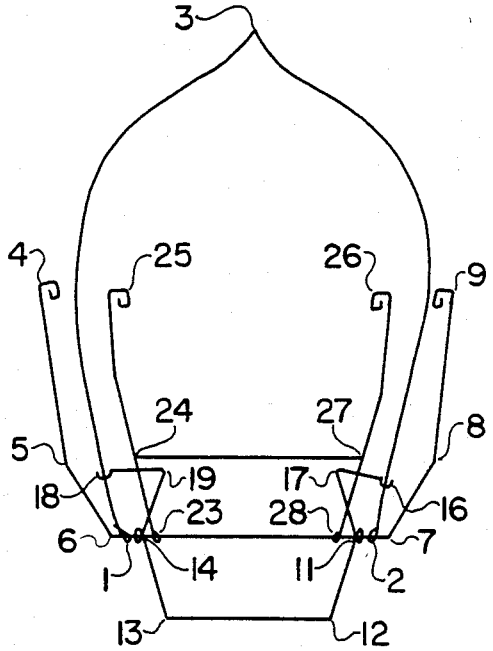
FIG. 12

DEVICE FOR CARRYING BAGS, PARTICULARLY REFUSE BAGS

The invention relates to a device for converting bags into baskets, particularly rubbish or refuse baskets and for supporting other objects and accessories.

The present invention relates more particularly to a device for carrying bags so as to make baskets out of them, particularly for rubbish, with the possibility of supporting one or more bags at one and the same time and/or other objects and accessories and which may serve for different uses.

The device of the present invention may carry bags of various sizes. It may be placed on the ground on a folding base or be suspended. It is made from plasticized resilient metal rods, but may be made from plastic and/or other materials. It normally comprises three supports: a support in the vertical position in the form of an upturned V with the sides, close to the angle, rounded. The ends of its arms each end in a ring shaped loop on which the second support may pivot formed by a shaft with its projections on both sides which are bent symmetrically forming with the shaft angles which set them up as two U shaped rods (where their joint which is the shaft is straight) and having at their ends fasteners for supporting the bag. The shaft for its part carries a third support which is the base and which also has the form of a U but horizontally through its loops which are situated at the ends of its two arms and which will be positioned between the rings of the arms of the vertical support. When the base is turned in the horizontal position, the two hooks which extend from the base from loops towards the arms of the vertical support hook onto the arms of this latter, locking the vertical support with the base and forming therebetween an angle normally of 90°. When the base is subjected to an opposite thrust, it is unlocked and folds. Thus, the present device may be set on its base holding the vertical support fixed and having the two rods joined in a U-shaped form pivoting freely between said two members. The bag is set on this device while having one side supported by the top of the vertical support where the angle of said support passes through the handle of the bag and a part of the wall is wrapped on the rounded sides. The opposite side of the bag is held by the fasteners at the ends of the two pivoting rods. The device may be suspended by its top angle and the base may be unlocked by folding so as to accomodate bags of great heights. On the same shaft several sets of two pivoting rods may be provided on both sides of the vertical support, but they will have the form of an H instead of a U with rings at their lower ends, considering that a shaft already exists. The first two rods on each side of the vertical support will support the bags in conjunction with the angle of the vertical support.

The bags which follow will be supported successively by the hooks of the four rods. The rods may vary in length.

The hooks on the ends of the two pivoting rods act in conjunction with loops, either which precede them or which surround them. The hook serves for piercing the side of the bag and the loop for supporting the pierced margin so as to prevent it from sliding downards. In the case where the hook is external to the loop, it will be provided with a cap for the sake of safety.

The pivoting rods may also be slanted vertically and symmetrically at a point along their arms each forming an angle which will produce a kind of suspension for reducing the tension on the side of the bag when this latter is suspended from the ends of said rods. The rods thus slanted also have the advantage of being able to be used for carrying a permanent decorative or advertising cover without causing the center of gravity of the device to be moved when the bag is filled.

It will be useful to emphasize that the pivoting rods which are made from a resilient material and each of which forms with their shaft an angle for folding them against the sides and opening them out again make it possible for the user to attain a variety of positions on the wall of the bag which will determine the dimensions and the shape of the opening of the bag.

The bag may be closed by pushing the two pivoting rods which hold one side of the bag towards the opposite side where their hooks will be slanted and retained behind the arms of the other support.

The base or the U shaped horizontal support may extend on one side or on both sides of the vertical support. For extending it on both sides, the arms of the horizontal support should be extended from the loops from where the shaft slides. The projections of the hooks will be extended from where the extensions of the arms have stopped.

The above described vertical support may have along its two arms loops or other means for supporting shafts and/or accessories, held in the vertical position by a base which extends on both sides and the shaft which joins them being removable. Thus, there is the possibility of arranging the members and/or accessories depending on requirements. At the bottom of one side a two rod pivoting support may be added for holding a bag and, on the other side, using the high loops for accomodating a horizontal support for laying thereon a tissue box, etc. The accessories may be folding and/or interchangeable.

In a variant, the above described vertical support in the form on an upturned V may be substituted by a vertical support having the shape of a U (where the joint of the two rods is straight) or in the form of an H held by a folding base. Their two high ends each end in a hook loop as described above. The arms may have loops along their length for supporting the same accessories as in the case of the vertical support in the form on an upturned V. The bags will always be supported by four rods which are sufficiently flexible, two of which will be pivotable, making it possible to readily accomodate a variety of bags. The device in this variant may be suspended from the wall using a support which has the form on an upturned V. The two ends of which end in hooks which may be inserted in the loop situated on the two arms of the vertical support in the form of a U or an H. This support makes it possible to do without the base, if it is desired simply to suspend the device.

In another variant, the above described base may be replaced by a base having the form of two crossed bars which fold up parallel. It consists of two bars made from plastic, wood or another material, one disposed above the other in parallel joined by a shaft at their center. The top one encircles the bottom one at the two ends by means of feet which arrive at the same level as the bottom bar. When the bottom bar is rotated to form a cross, the four ends of the bars will be at the same level. The top bar may be connected to the two feet of the arms of any vertical support mentioned above by holding them in the straight position.

A clearing device for emptying the contents of objects into the bag is an accessory to this device which may be added as an integral part. It includes an empty circle or ring with its support which is fixed at the side of the angle of the vertical support for situating it at the opening of the bag. It has been made round for reaching into the hollows and profiled shapes of dishes or other receptacles. It may be removable for replacing it by a wiper or other stable or mobile geometrical figure for emptying and/or wiping objects.

A variant consists in simplying the device by reducing it to two elements: the vertical support with the two pivoting rods, that is to say by eliminating the base. Thus, the bag will be supported as in the case of the three element device, by the vertical support on one side and the two pivoting rods on the other. The device may be simply suspended by the angle at the top. It may be equipped with a clearing device.

In another variant, the device is further reduced to a vertical support in the form of an upturned V as described above but having the arms reduced and/or folded so as to support a clearing device which forms an integral part therewith. The bag will be supported on one side only. The device will be suspended by its top angle.

A variant in the construction of the horizontal support resides in the fact that it may have pivots in place of loops for replacing the use of a shaft. The horizontal support will always have its projections which end in a hook on each side and which hook onto the arms of the vertical support so that it is horizontally locked therewith.

FIG. 1 shows in a front view the device of the invention set on its base which extends on a single side, before the bag has been positioned, FIG. 2 shows, in a side view, the device, supporting a transparent plastic bag, set on its base, FIG. 3 shows, in a side view, the device supporting a bag and hooked onto a wall and having the base unlocked so as to accommodate bags of long dimensions, FIG. 4, 5, 6, 7, 8, 9, 10, 11 show the accessories, such as bases or shelves and shafts, in various forms and positions, FIG. 12 shows, in a front view, the device of the invention set on its base which extends on both sides of the vertical support and, on the opposite side, pivots a twin rod support in the form of a U which forms at the same time the shaft for joining its two rods together and on the opposite side pivots another twin rod support which has the shape of an H, considering that it pivots on the same axis of the first support. This device makes it possible to support a bag on each side of the vertical support.

FIG. 13 shows, in a front view, the device without its elements except for the vertical support which has loops along both its sides and its folding base which holds it vertically and an independent shaft which joins the two together. Thus presented, elements and acessories may be added thereto in a desired arrangement.

FIGS. 14 and 15 show, in a front view, the device in two different arrangements. FIG. 14 has the vertical support equipped on each side with two pivoting U shaped rods, but placed at different levels. They are in position ready, each one, to support a bag. FIG. 15 shows that the vertical support has on one side two pivoting rods in the open position at the level of the base and, on the other side, a horizontal support which extends from one side, like a shelf mounted on the top loops of the vertical by means of a removable shaft which is locked by its hooks at both sides of the vertical. The two FIGS. have their vertical support held by a folding base which extends on both sides of the vertical support.

FIG. 16 shows, in a side view, the device of the invention supporting a bag and laid on a base which varies from the preceding ones. It is in the form of two crossed bars which fold up parallel. The upper bar is connected to the feet of the two arms of the vertical support. The FIG. also shows an accessory which is the clearing means and which is fixed by its support at the side of the angle of the vertical support.

FIG. 20 shows, in a front view, a support for fastening the vertical U or H shaped support shown in FIGS. 18 and 19 to a wall or similar.

Figure 13:
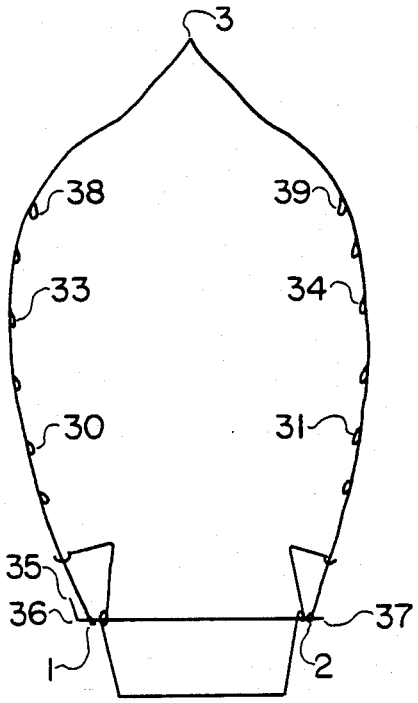

FIGS. 1, 2 and 3 show a bag carrying device of the invention including three elements: a vertical frame (1, 3, 2) a folding base (15, 14, 13, 12, 11, 10) see also FIG. 4, and twin pivoting rods (4, 5, 6) and (9, 8, 7) which are joined at 6 and 7 forming together a U shape where the shaft (6, 7) joins the three elements together by loops 1 and 2 belonging to the vertical frame (1, 3, 2) and loops 14 and 11 belonging to the base (15, 14, 13, 12, 11, 10). By joining hooks 10 and 15 belonging to the base with the arms of the frame (1, 3, 2), the frame is locked with the base forming therebetween normally an angle of 90°. The twin rods (4, 5, 6) and (9, 8, 7) with their shaft (6, 7) remain free to pivot between the two elements.

A transparent plastic bag 40 is positioned having the opening 41 of its handle disposed over angle 3. The handle and a part of the wall are wrapped at 42 and 43. The opposite side of the bag is pulled under the vault of the frame and fastened on hooks 4 and 9 which are at the end of the twin pivoting rods. The bag is thus supported and held open in front by the thrust of the twin pivoting rods and by the sides since the rods which form angles 6 and 7 and are made of a resilient material pull on two opposite sides. Thus the bag will be held open width wise and depth wise. For bags which have great heights, the base of the device may be unlocked by releasing hooks 10 and 15, and the base (14, 13, 12, 11)

folds up and is disposed vertically as shown in FIG. 3 and/or the device is suspended by its angle 3.

The twin pivoting rods are bent at 5 and 8 each forming an angle which makes it possible to create a suspension so as to reduce the tension on the bag when this latter is supported by the two rods (4, 5, 6) and (9, 8, 7). The two rods (4, 5) and (9, 8) thus slanted offer another advantage which makes it possible for them to support a permanent decorative or advertising cover without moving the center of gravity of the device when the bag fills up.

FIG. 12 shows that the base (18, 19, 14, 13, 12, 11, 17, 16) see also FIG. 7, extends on both sides of the vertical frame (1, 3, 2).

On the same shaft (6, 7) as the twin rods (4, 5, 6) and (9, 8, 7) two or more twin pivoting rods may be provided for supporting two or more bags at the same time, as shown in FIG. 12 at (25, 24, 23) and (26, 27, 28) joined together by the joint (24, 27). At 23 and 28 are shown the loops belonging to the twin rods in the form of an H through which the shaft (6, 7) slides. The hook loops at 25, 26, 4 and 9 are here shown in another way. They are formed so that the loop encircles the hook as a safety measure. In the other system, which is shown in the other drawings as in FIG. 1, the hook extends outside of the loop, in which case the hooks may be equipped with caps.

Figure 14:
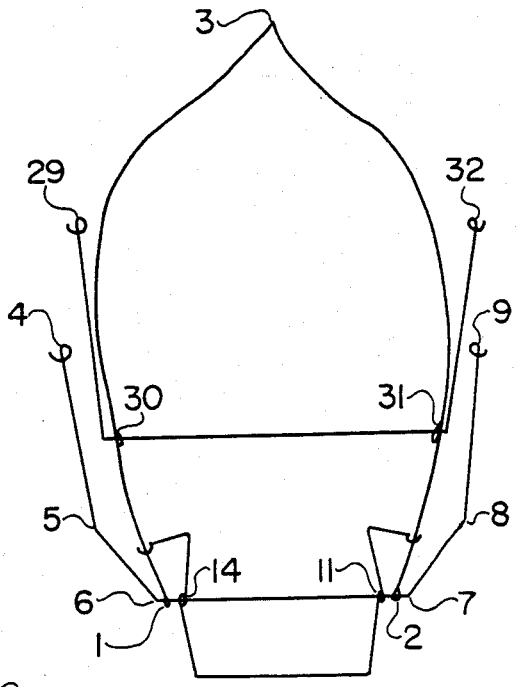
Figure 15:
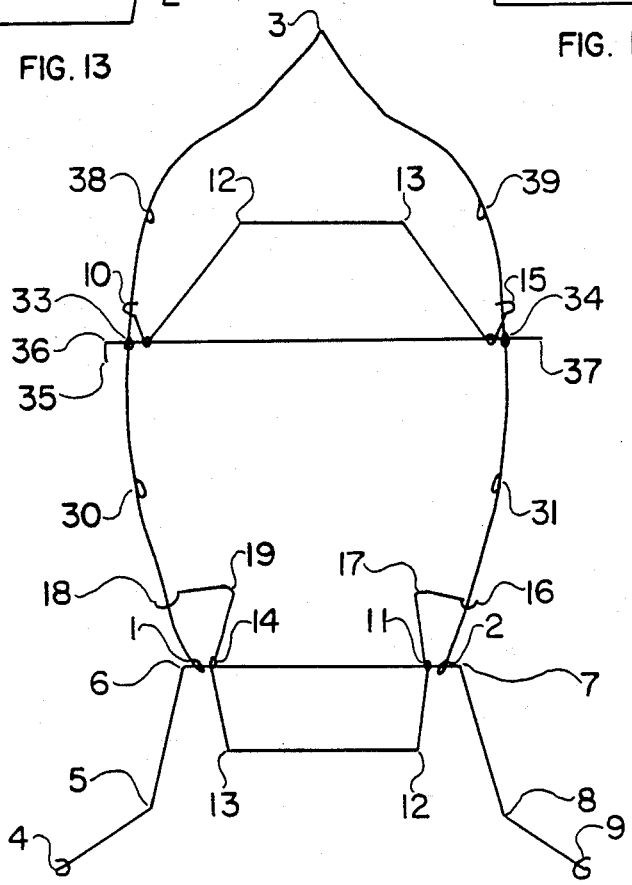

FIGS. 13, 14 and 15 show that the vertical frame (1, 3, 2) may be provided along its two arms with loops such as 1, 30, 33, 38, 39, 34, 31, 2 or by a support means for accomodating shafts or pivots. The vertical frame may be held by a base (18, 19, 14, 13, 12, 11, 17, 16) which may be foldable, and removable using an independent shaft (35, 36, 37) as shown in FIG. 13. With these basic elements, any desired arrangement may be made, as shown in FIGS. 14 and 15. FIG. 14 shows that the independent shaft has been replaced by the shaft (6, 7) belonging to the twin pivoting rods (4, 5, 6) and (9, 8, 7). Two other pivoting rods in the shape of a U (29, 30) (32, 31) in conjunction with their shafts (30, 31) are placed on higher loops at 30 and 31. Which means that this arrangement makes it possible to support two bags at the same time. FIG. 15 shows another arrangement where, on one side of the frame, twin pivoting rods (4, 5, 6, 8, 9) in the form of a U are installed which are slanted at the level of the base, and which may be raised for supporting a bag conjointly with the top of the frame; and on the other side, on an independent shaft (35, 36, 37) which is supported by the loops of the frame at 33 and 34, is disposed a support (10, 11, 12, 13, 14, 15) by means of loops 11 and 14 and which is fixed in the horizontal direction by its hooks (11, 10) and (14, 15) hooking onto the sides of the frame at 10 and 15. The horizontal frame thus formed may support a tissue box or a tray, etc. This support, like all the other elements of the device, is made of plasticized resilient metal rod. Other supports may be added and be locked at any angle depending on the requirements.

Figure 16:
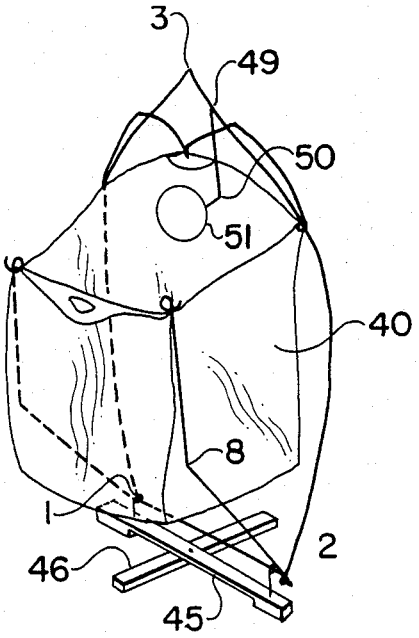
Figure 17:
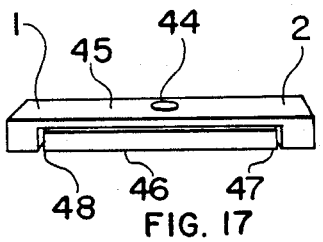
FIG. 17 shows, in a front view, the cross shaped base applied to the device of FIG. 16, in the closed position.

FIG. 16 is the same as FIG. 2 except that the base has been replaced by a base formed of two bars 45 and 46, which are crossed by their center 44 and fold up parallel, FIG. 17. The ends of the bottom bar reach points 47 and 48, which means that the top bar may have feet so that the four ends of the two bars have the same level when they are crossed. The vertical frame (1, 3, 2) is connected to the base by its two projections 1 and 2 which are fixed to the upper bar. FIG. 16 shows the device with a clearing means (51, 50, 49) which is an optional accessory and which may be an integral part of the device of the invention.

Figure 20:
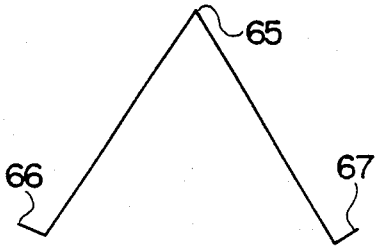
Figure 18:
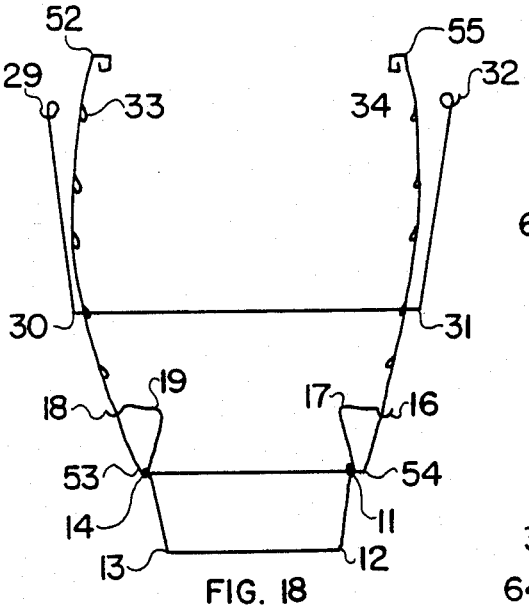
FIG. 18 shows, in a front view, the device with its vertical U shaped support and the ends of the vertical in the form of hooks serving as supports, held by a folding base. On the two arms of the vertical support are disposed two pivoting rods supported by the loops provided on the two arms.
Figure 19:
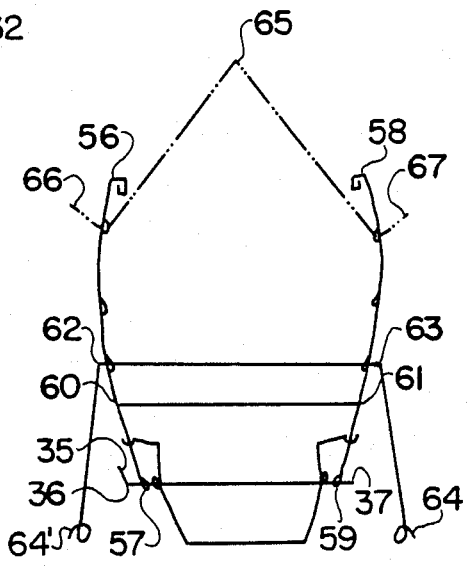
FIG. 19 shows, in a front view, the device with its vertical support in the form of an H and the ends of the vertical in the form of hooks serving as supports, held by a folding base by means of a shaft. On the two arms of the vertical support are set two pivoting rods supported by the loops provided on the two arms.

A variant to the vertical frame would be a frame having the form of a U and/or of an H held vertically as shown in FIGS. 18 and 19. The vertical (52, 53, 54, 55) of FIG. 18 is held by a folding base (16, 17, 11, 12, 13, 14, 19, 18). The vertical by means of its loops 30 and 31 supports twin pivoting rods in the form of a U (29, 30, 31, 32). The bag will be supported by the hook loops of the four rods, on one side by 52 and 55 and on the opposite side by 29 and 32. The FIG. shows the two kinds of hook loops. FIG. 19 shows the vertical frame in the form of an H. Rod (56, 60, 57) and rod (58, 61, 59) are joined together by the joint (60, 61). At their ends 56 and 58 they form hook loops and at the bottom ends 57 and 59 they form loops for passing therethrough a shaft (35, 36, 37) on which the base is held in position and is fastened to the sides of the vertical so as to hold it at an angle normally of 90°. As in the preceding cases, twin pivoting rods or horizontal supports may be provided along the two arms. The two U shaped or H shaped vertical frames may be suspended using a support (66, 65, 67) shown in FIG. 20, where the hooks at 66 and 67 hook onto loops which are provided on the two arms of the verticals which may be at 33 and 34 or those which are placed lower down. Said devices may then be suspended by the angle 65.

Figure 21:
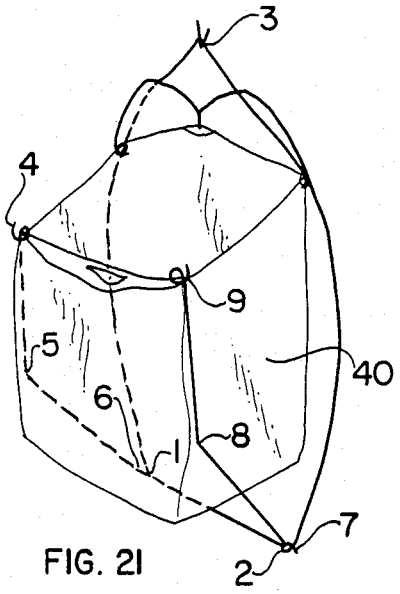
FIG. 21 shows, in a side view, the device reduced to two elements: the vertical support and the twin pivoting rods, without the base, supporting a transparent plastic bag and suspended from a wall. (It is shown in sheet 6/8).

FIG. 21 shows the device reduced to two elements: the vertical support (1, 3, 2) and the two rod assembly (4, 5, 6) and (9, 8, 7) which are joined by the shaft (6, 7) which pivots on the rings of the two arms of the vertical support at (1) and (2). It supports a bag 40 in the same way as in FIGS. 2, 3 and 16. It is suspended by its top angle (3).

Figure 22:
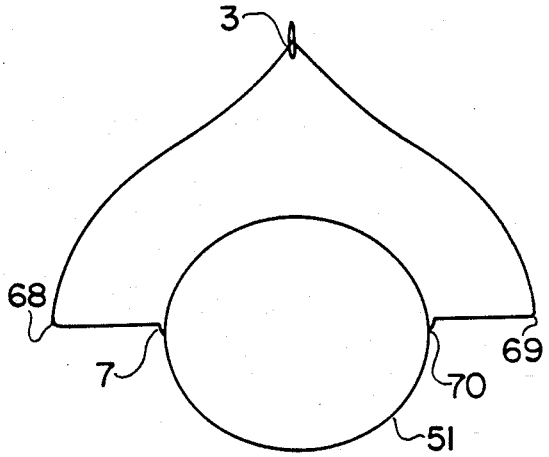
FIG. 22 shows, in a front view, the device reduced to one element which is the vertical support shortened and integrated with the clearing means, suspended on a wall.
Figure 23:
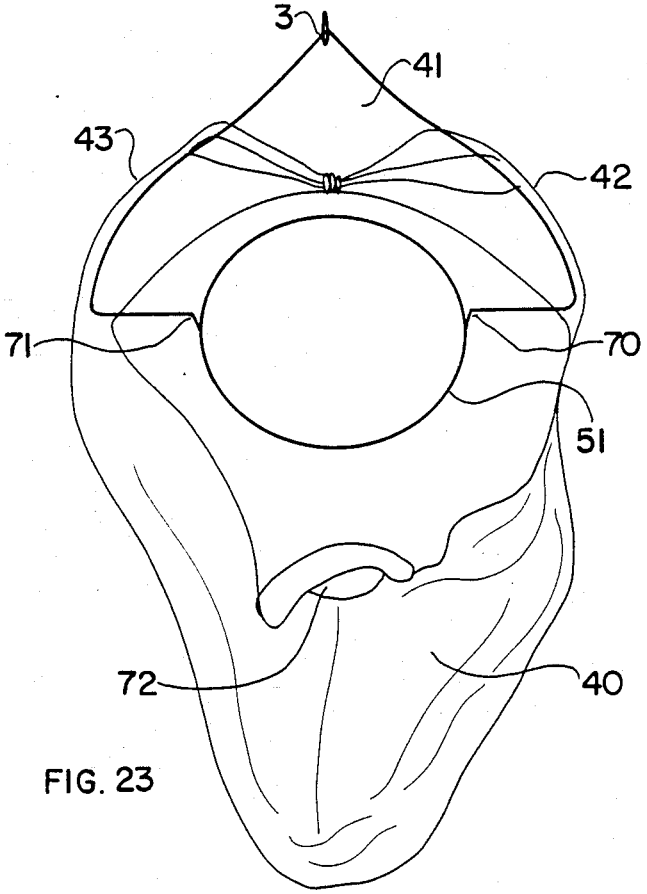
FIG. 23 is the same as FIG. 22 but supporting a transparent plastic bag.

FIGS. 22 and 23 show the device (68, 3, 69), still formed as a rod, reduced to a minimum and having the two support forming arms (70) and (71) folded and extended so as to hold or form the clearing means (51) which is projected towards the center of the opening of the bag (40), as shown in FIG. 23. The bag is supported on a single side. The angle (3) passes through the opening of the handle (41) and a part of the wall of the bag is wrapped on the rounded parts of the device (42) and (43). The opposite side of the bag (72) remains unsupported.

I claim:

1. A device for supporting bags of various dimensions to convert them into baskets, particularly for refuse, providing support of one or more bags and other objects at the same time, which comprises:

(a) a first support vertically disposed comprising two arms forming an angle having the shape of an upturned V, said arms being rounded close to the angle at the base of the V and having at their ends means through which a shaft of a second support member can pivot, said angle receiving around it a handle of one side of the bag to be supported and also serving for suspending the device to a hanger;

(b) the second support member which comprises said shaft presenting at its ends two arms to form a wide open U, said arms of the second support member being flexible and having at their ends supporting means for the opposite side of the bag, pivoting of said second support member allowing said supporting means to hold the walls of the bags at different locations permitting the size and shape of the bag opening to vary; and (c) a third support member comprising a folding base which rotates on the shaft of said second support member, said folding base having locking means adapted to co-act with the first support member to lock together said folding base and said first support member, allowing the device to be stood on the ground, the second support member being freely pivotable therebetween, said folding base being able to be unlocked and unfolded to allow accommodation of bags of greater heights.

2. Device according to claim 1 wherein the supporting means of the two arms of the second support member comprises a hook and a loop, said hook serving for piercing the side of the bag and the loop for supporting the pierced side so as to prevent it from sliding downwards, and hook and loop being adapted to the bag.

3. Device according to claim 1 wherein said two arms of the second support member are slanted vertically and symmetrically at least at a point along their lengths, forming angles on each arm.

4. Device according to claim 1 wherein said folding base is made of a flexible material and has two arms to present the shape of a U, each arm of said folding base being provided with a loop, said loops allowing the folding base to rotate about the shaft of the first support member, said arms of the folding base each presenting an extension with grip means adapted to grip the arms of the first support member to lock the folding base to the first support member at an angle of about 90 degrees.

5. Device according to claim 1 wherein the second support member holds on its shaft several pairs of arms moving on either side of the first support member, said pairs of arms having the shape of an H instead of a U and the lower ends thereof having loops, said shafts passing through said loops while their upper ends have means for supporting one side of the bag, the opposite side of the bag being held by an adjacent support.

6. Device according to claim 1 wherein the first support member is provided along its two arms with carrying means which comprises lower carrying means at the bottom of said arms for fixing a base holding the first support member vertically and other carrying means at other levels along said arms to carry supports comprising two twin pivoting rods, said supports being free to pivot and to be locked.

7. Device according to claim 1 wherein the first support member is of a straight U shape made of flexible material, the upper end of each arm of the first support member having a hook loop type means to hold the bag by four arms.

8. Device according to claim 1 wherein the first support member is of an H shape made of flexible material, the upper end of each arm of the first support member having a hook loop type means to hold the bag by four arms, the lower ends of the arms of the first support member each having a loop to allow said first support member to rotate about the shaft of the second support member.

9. Device according to claim 1 wherein the folding base comprises two crossed bars comprising a lower bar and an upper bar joined together by a shaft at a middle point, the upper bar co-acting with lower ends of the two arms of the first support member and comprising feet having lower faces at a same level as lower faces of feet of the lower bar, said upper and lower bars being adapted to rotate and spread away from each other to put the device in an upright position.

10. Device according to claim 4 wherein said folding base comprises pivots integrated therewith adapted to co-act with carrier means of the first support member.

11. Device according to claim 1 wherein the arms are made of plasticized resilient metal.

12. A device for supporting bags of various dimensions to convert them into baskets, particularly for refuse, providing support to one or more bags and other objects at the same time, which comprises:

(a) a first support member comprising two arms forming an angle having the shape of an upturned V, said arms being rounded close to the angle and being provided at their ends with means through which a shaft of a second support member pivots, said angle receiving around it a handle of one side of the bag to be supported and also serving for suspending the device to a hanger; and (b) the second support member comprising said shaft presenting at its ends two arms to form a wide open U, said arms of the second support member being flexible and having at their ends supporting means for the opposite side of the bag, pivoting of said second support member allowing said supporting means to hold the walls of the bags at different locations permitting the size and shape of the bag opening to vary.

13. Device according to claim 12 wherein the arms of said first support member are reduced to support clearing means having a circular shape and forming an integral part therewith, said clearing means projecting forwardly to reach the opening of the bag when the latter is hooked thereon.

14. Device according to claim 12 wherein the arms are made of plasticized resilient metal.

* * * * *